United States Patent [19]

Morgan et al.

[11] Patent Number: 4,612,162

[45] Date of Patent: Sep. 16, 1986

[54] METHOD FOR PRODUCING A HIGH DENSITY METAL ARTICLE

[75] Inventors: Ricky D. Morgan, Ulster; Vito P. Sylvester, Athens; Robert L. Ward, Towanda, all of Pa.

[73] Assignee: GTE Products Corporation, Stamford, Conn.

[21] Appl. No.: 774,849

[22] Filed: Sep. 11, 1985

[51] Int. Cl.[4] ..... B22F 3/24

[52] U.S. Cl. ..... 419/28; 419/23; 419/29; 419/38; 419/48; 419/49; 419/53; 419/54; 419/57; 75/245; 75/248

[58] Field of Search ..... 419/26, 28, 29, 49, 419/57, 58, 53, 54, 23, 48; 75/245, 248

[56] References Cited

U.S. PATENT DOCUMENTS

| | | | |
|---|---|---|---|
| 4,431,605 | 2/1984 | Lueth | 419/49 |
| 4,448,747 | 5/1984 | Moritoki et al. | 419/49 |
| 4,455,278 | 6/1984 | van Nederveen et al. | 419/49 |

*Primary Examiner*—Stephen J. Lechert, Jr.

*Attorney, Agent, or Firm*—Donald R. Castle; L. Rita Quatrini

[57] ABSTRACT

An improvement is disclosed in a method for producing a metal article of high density comprising pressing a metal powder at a sufficient pressure to form a green article and sintering said green article at a sufficient temperature for a sufficient time to form a sintered article, the improvement being pressing the sintered article at a sufficient temperature for a sufficient time at a sufficient pressure of a non-oxidizing atmosphere to produce the final high density article.

3 Claims, No Drawings

METHOD FOR PRODUCING A HIGH DENSITY METAL ARTICLE

BACKGROUND OF THE INVENTION

This invention relates to an improvement in a method for producing a high density metal article from a metal powder involving cold pressing and sintering the powder, the improvement being hot isostatic pressing of the cold pressed and sintered article.

The usual technique used to produce metal parts is via powder metallurgical processing. Instead of melting solid metal, pouring it into molds and removing the part from the mold, with powder metallurgy, the starting material is a metal powder. The metal powder is formed to a desired shape and then sintered or heated to convert it to solid metal. Basically, this is a two-step operation involving cold isostatic pressing in a high pressure vessel and sintering in a furnace. Since the part contracts or shrinks when made by this method, a larger starting shape must be used to produce the desired finished part. For instance, the density of the metal in powder form is normally 25% to 40% of theoretical density (very porous), the density after pressing (green state) is normally 60% to 70% of theoretical density and the sintered part is normally 93% to 97% of theoretical density. Thus, the shrinkage effect can be seen — as the density increases, the porosity decreases and thus the size and volume decreases since the weight remains the same. The final size is divided by a shrink factor which provides the mold starting size the powder will contact. Molds are typically rubber bags which are placed inside of steel containers that maintain the shape of the molds. Metal powder is placed inside the mold which is the desired shape (round, square, tubular, etc.) and this mold is sealed either by liquid rubber or by mechanical means such as clamps. Thus, the powder is totally enclosed by rubber. This is required since the entire assembly will be placed in a high-pressure vessel which uses an oil or water medium as a pressing agent and this step is referred to as cold isostatic pressing. The part is placed in the press, the press is sealed, water or oil is pumped into the vessel at high pressure (20 ksi to 45 ksi), the part is now in the as-pressed or "green" state in which the part can be handled but will chip or break if dropped, hammered, etc. The part is then placed in a furnace, heated or sintered below its melting point resulting in a powder to solid transformation — coalescing of powder particles, and formation of metallic grains and grain boundaries. Thus a sintered or solid metal part is produced.

Powder metallurgy is used for two main reasons:

1. It reduces the starting material weight since parts can be formed to near net shape. This also reduces machining time if the part is to be machined.

2. It allows a lower usage of energy to produce solid metallic parts-sintering temperatures are much lower than required melting temperatures if the parts are to be cast.

One disadvantage of powder metallurgically produced parts is that full densification cannot be achieved unless sintered for an extremely long duration of time which results in undesirable grain growth and decreased properties.

Therefore, a process for producing essentially fully densified metal parts without excessively long sintering times would be an advancement in the art.

SUMMARY OF THE INVENTION

In acordance with one aspect of this invention, there is provided an improvement in a method for producing a metal article of high density comprising pressing a metal powder at a sufficient pressure to form a green article and sintering said green article at a sufficient temperature for a sufficient time to form a sintered article, the improvement being pressing the sintered article at a temperature of at least about 175° C. for a sufficient time at a pressure of at least about 20,000 psi of a non-oxidizing atmosphere to produce the final high density article the metal powder containing at least one of the metal powders of molybdenum and tungsten.

DETAILED DESCRIPTION OF THE INVENTION

For a better understanding of the present invention, together with other and further objects, advantages, and capabilities thereof, reference is made to the following disclosure and appended claims in connection with the above description of some of the aspects of the invention.

The metal powder of this invention contains at least one of the metal powders of molybdenum and tungsten. Therefore, the metal powder can be essentially all molybdenum, essentially all tungsten or mixtures thereof. The metal powder can also be powder alloys containing at least one of the metal powders of molybdenum and tungsten, such as heavy metal alloys. Especially preferred are essentially all molybdenum and essentially all tungsten powder. Some other preferred powders are as follows in percent by weight: (1) about 30% tungsten and the balance molybdenum, (2) about 25% tungsten and the balance molybdenum, (3) about 2% thoria and the balance tungsten, (4) about 0.5% titanium, about 0.1% zirconum, and the balance molybdenum, (5) about 1% hafnium carbide, and the balance molybdenum, (6) about 1% hafnium carbide, about 25% tungsten, and the balance molybdenum, (7) 1% hafnium carbide, about 45% tungsten, and the balance molybdenum. Tungsten-rhenium mixtures can also be used.

The metal powder is cold pressed and sintered according to well known methods. This operation must result in the sintered article having a density of at least about 90% of the theoretical density, so that the sintered article can be adequately pressurized in the subsequent hot isostatic pressing operation. Maximum densities of no greater than about 97% of the theoretical density can be obtained typically.

In order to further densify the resulting sintered article, it is subjected to a hot isostatic pressing operation as described below.

The sintered article is placed in a hot isostatic press. Any standard hot isostatic press can be used.

The pressing is done in a non-oxidizing atmosphere such as argon and nitrogen and preferably argon at a sufficient temperature for a sufficient time at a sufficient pressure to produce the final article which has a density of typically greater than about 97% of the theoretical density. When molybdenum metal powder is used, densities greater than about 99% of the theoretical density can be attained.

It will be obvious to those skilled in the art the hot isostatic pressing conditions of temperature, pressure, and time can vary depending on the particular metal powder composition and also on the type of equipment used.

In general, the temperature must be lower that the melting point of the metal powder composition. The pressure depends on the temperature with the pressure decreasing as the temperature is increased. The length of time of the hot isostatic pressing operation depends on the temperature and pressure. For example, with one particular type of equipment, for powder which is essentially all molybdenum, which has a melting point of about 2610° C., the temperature is preferably from about 1750° C. to about 1850° C., and most preferably from about 1750° C. to about 1800° C. The pressure is preferably from about 20,000 psi to about 28,500 psi with from about 27,000 psi to about 28,500 psi being preferred.

The pressing time depends on the temperature and pressure. Typically at a temperature of about 1800° and a pressure of about 28,500 psi, the time is about 100 minutes to obtain near theoretical density in an article measuring about 4"×7"×8".

When the article is essentially all tungsten, a minimum of about 1800° C. at a pressure of about 28,000 psi is required to achieve maximum theoretical density.

The hot isostatic pressing of metal powder produces articles or parts near to about 100% of the theoretical density through simultaneous application of pressure and temperature. This achievement of very high density provides articles with improved properties over conventionally manufactured powder-metallurgy articles which use a cold isostatic pressing step and a sintering step. Because the sintered articles have sufficient density, they can be hot isostatically pressed without use of a container. The advantages of containerless hot isostatic pressing are less expensive equipment, no contamination of the article with the container, etc.

Furthermore with the improvement of this invention, the shrinkage in the hot isostatic pressing step is negligible. Therefore, the capability of existing equipment is expanded because larger parts can be densified to near theoretical density. Also, if subsequent metal working of the final article is necessary, this can be done with less risk of damage to the article because of the high density of the final article. The grain size of a hot isostatically pressed article is essentially the same as that of the sintered article.

To more fully illustrate this invention, the following non-limiting examples are presented. All parts, portions, and percentages are on a weight basis unless otherwise stated.

EXAMPLE 1

Molybdenum articles are pressed in a furnace measuring about 9" diameter by about 24" in length. Table 1 below summarizes densities of the starting as sintered parts versus densities of the corresponding resulting hot isostatically pressed parts as percent of the theoretical density. Number 1 represents data on 4 molybdenum nuts. Hot isostatic pressing conditions are at 1850° C. at about 20,000 psi for about 4 hours. Numbers 2 thru 7 are molybdenum blocks measuring about 4"×7"×8". Hot isostatic pressing conditions are at about 1800° C. at about 28,500 psi of argon gas for about 1.66 hours.

TABLE 1

| Product | As-Sintered Density (Percent of Theoretical) | As-HIP'ed Density (Percent of Theoretical) |
|---|---|---|
| 1 | 93.4 | 99.4 |
| 2 | 95.3 | 100.00 |
| 3 | 95.5 | 99.8 |
| 4 | 95.1 | 99.89 |
| 5 | 95.0 | 99.87 |
| 6 | 95.3 | 99.98 |
| 7 | 95.2 | 100.00 |

It can be seen that the hot isotatically pressed parts are essentially fully densified. Some physical properties of two of the above products are given below in Table 2.

TABLE 2

| Product | UTS (psi) | YS (psi) | As-Sintered Hardness | As-HIP'ed Hardness |
|---|---|---|---|---|
| 1 | | | $R_b$ 72 | $R_b$ 96 |
| 7 | 60,400 | 41,000 | | 174 Vickers |

Hardness data show an improvement after hot isostatic pressing when compared to pressed and sintered samples.

EXAMPLE 2

Table 3 below summarizes density data on metal articles. The as is density is given along with the as HIP'ed density of this invention in the form of percent of theoretical density.

TABLE 3

| Product | As-Sintered Density (Percent of Theoretical) | As-HIP'ed Density (Percent of Theoretical) |
|---|---|---|
| 2% Thoria balance W 1" and 2" dia. bars | 93 to 93.4 | 98.6 to 99 |
| W billet | 92.0 | 98.5 |
| W fabricated part | 95.5 | 98.1 |
| W 2" dia. disc | 94.0 | 97.8 |
| W 3" dia. disc | 95.9 | 97.4 |
| W billet | 91.8 | 98.8 |
| W billet | 91.7 | 99.3 |
| W billet | 95.2 | 99.1 |
| W billet | 94.6 | 99.2 |

As the data shows, increases in density are substantial in the HIP'ed articles over the as-sintered articles. Also no grain growth is apparent when the microstructure of the as HIP'ed articles is examined. An increase in grain size is detrimental to properties of the article. The as HIP'ed articles show improved workability over the as sintered articles.

While there has been shown and described what are at present considered the preferred embodiments of the invention, it will be obvious to those skilled in the art that various changes and modifications may be made therein without departing from the scope of the invention as defined by the appended claims.

What is claimed is:

1. In a method for producing a metal article of high density comprising pressing a metal powder at a sufficient pressure to form a green article and sintering said green article at a sufficient temperature for a sufficient time to form a sintered article, the improvement comprising pressing said sintered article at a temperature of at least about 1750° C. for a sufficient time at a pressure of at least about 20,000 psi of a non-oxidizing atmpshere to produce the final high density article, said powder containing at least one of the metal powders of molybdenum and tungsten.

2. An improvement of claim 1 wherein said non-oxidizing atmosphere is selected from the group consisting of argon and nitrogen.

3. An improvement of claim 1 wherein the density of said final article is greater than about 97% of the theoretical density and the grain size of said final article is essentially the same as the grain size of said sintered article.

* * * * *